US011644160B1

(12) United States Patent
Xu

(10) Patent No.: US 11,644,160 B1
(45) Date of Patent: May 9, 2023

(54) LAMP AND LAMP STRING

(71) Applicant: DONGGUAN LIGHT SHINES ELECTRIC LIGHTING CO., LTD, Dongguan (CN)

(72) Inventor: Qingjun Xu, Dongguan (CN)

(73) Assignee: DONGGUAN LIGHT SHINES ELECTRIC LIGHTING CO., LTD, Dongguan (CN)

( * ) Notice: Subject to any disclaimer, the term of this patent is extended or adjusted under 35 U.S.C. 154(b) by 0 days.

(21) Appl. No.: 17/745,533

(22) Filed: May 16, 2022

Related U.S. Application Data

(63) Continuation of application No. PCT/CN2021/133208, filed on Nov. 25, 2021.

(30) Foreign Application Priority Data

Nov. 11, 2021 (CN) ..... 202122765461.6

(51) Int. Cl.
*F21S 4/10* (2016.01)
*F21V 17/12* (2006.01)
(Continued)

(52) U.S. Cl.
CPC ..... *F21S 4/10* (2016.01); *F21V 17/12* (2013.01); *F21V 17/10* (2013.01); *F21V 17/104* (2013.01); *F21V 17/16* (2013.01); *F21V 17/164* (2013.01)

(58) Field of Classification Search
CPC ..... F21V 17/12; F21V 17/04; F21V 17/06; F21V 17/10; F21V 17/104; F21V 17/14;
(Continued)

(56) References Cited

U.S. PATENT DOCUMENTS 4,935,852 A * 6/1990 Hsu ..... F21S 4/10 362/382
5,021,706 A * 6/1991 Chen ..... F21S 4/10 313/318.09
(Continued)

FOREIGN PATENT DOCUMENTS

CN 2433507 Y 6/2001
CN 202972620 U 6/2013
(Continued)

OTHER PUBLICATIONS

International Search Report and Written Opinion of PCT/CN2021/133208 dated Mar. 28, 2022, 9 pages (English and Chinese).

*Primary Examiner* — Bryon T Gyllstrom
*Assistant Examiner* — James M Endo
(74) *Attorney, Agent, or Firm* — Dicke, Billig & Czaja, PLLC

(57) ABSTRACT

A lamp and a lamp string are disclosed. According to the lamp base and the lampshade of the disclosure, the lampshade is connected with the lamp base, an inner wall of the lamp base is provided with a first flange and a second flange, an outer wall of the lampshade is formed with a first abutting surface and a second abutting surface, the first flange abuts against the first abutting surface, and the second flange abuts against the second abutting surface. The first abutting surface is a conical surface, a diameter of the lampshade at a position corresponding to the first abutting surface gradually decreases along a direction towards the lamp base, and an included angle between the first abutting surface and the second abutting surface is an obtuse angle.

18 Claims, 7 Drawing Sheets

(51) Int. Cl.
*F21V 17/10* (2006.01)
*F21V 17/16* (2006.01)

(58) Field of Classification Search
CPC ..... F21V 17/16–18; F21S 4/10; F21K 9/232; F21K 9/235; F21K 9/237; F21K 9/23
See application file for complete search history.

(56) References Cited

U.S. PATENT DOCUMENTS 5,517,394 A * 5/1996 Lin ..... F21S 4/10 362/311.06
5,626,415 A * 5/1997 Huang ..... F21V 17/06 362/267
5,931,568 A * 8/1999 Chuang ..... F21V 3/00 362/311.03
6,022,241 A * 2/2000 Lin ..... H01R 4/2412 439/619
6,382,812 B1 * 5/2002 Hsu ..... F21V 19/006 439/699.1
9,625,105 B2 * 4/2017 Tong ..... F21K 9/64
10,047,913 B1 * 8/2018 Hsu ..... H01K 1/34
2007/0153531 A1 * 7/2007 Lin ..... F21S 4/10 362/362
2008/0143234 A1 * 6/2008 Yu ..... F21V 17/06 313/318.09
2009/0086492 A1 * 4/2009 Meyer ..... F21V 29/85 362/294
2009/0251923 A1 * 10/2009 Yu ..... F21V 31/005 362/653
2010/0002451 A1 * 1/2010 Reynolds ..... F21S 8/02 362/363
2011/0193473 A1 * 8/2011 Sanders ..... F21K 9/232 313/483
2011/0227102 A1 * 9/2011 Hussell ..... F21V 3/08 257/89
2013/0107523 A1 * 5/2013 Takeda ..... F21V 13/02 362/235
2013/0114268 A1 * 5/2013 Shigematsu ..... F21S 8/033 362/308
2013/0119866 A1 * 5/2013 Matsuda ..... F21V 3/02 315/112
2015/0176785 A1 * 6/2015 Liu ..... F21V 31/00 362/392
2015/0211717 A1 * 7/2015 Liu ..... F21V 3/02 362/310
2016/0010814 A1 * 1/2016 Peng ..... F21S 4/10 362/244
2016/0273716 A1 * 9/2016 Tarsa ..... F21K 9/61
2018/0128447 A1 * 5/2018 Chen ..... F21K 9/61
2018/0372278 A1 * 12/2018 Zhang ..... F21V 23/06
2019/0341718 A1 * 11/2019 Yu ..... F21V 21/096
2020/0032986 A1 * 1/2020 Zhang ..... F21V 23/001

FOREIGN PATENT DOCUMENTS

CN 207394459 U 5/2018
CN 207990274 U 10/2018
CN 112815239 A 5/2021
TW 201237309 A 9/2012

* cited by examiner

LAMP AND LAMP STRING

CROSS-REFERENCE TO RELATED APPLICATIONS

This application is a bypass continuation of international application number PCT/CN2021/133208, filed Nov. 25, 2021, which claims priority to Chinese patent application No. 2021227654616 filed Nov. 11, 2021. The contents of these applications are incorporated herein by reference in their entirety.

TECHNICAL FIELD

The disclosure relates to the technical field of lighting, and more particularly, to a lamp and a lamp string.

BACKGROUND

As common devices for daily lighting and background rendering, lamps are widely used in various scenes, and waterproofness is an important factor affecting the service life of a lamp. When the lamp is used in the open air, in case of encountering rain and high humidity, it is inevitably for the lamp to suffer from rain or water vapor infiltration, which will seriously affect the service life of the lamp, and even easily cause the lamp to burst.

SUMMARY

The disclosure aims at solving at least one of the technical problems in the existing technology. To this end, the disclosure provides a lamp which has a better water-proofing performance.

The disclosure further provides a lamp string having the above-mentioned lamp. A lamp according to an embodiment of a first aspect of the disclosure includes a lamp base and a lampshade. The lampshade is connected with the lamp base, an inner wall of the lamp base is provided with a first flange and a second flange, an outer wall of the lampshade is formed with a first abutting surface and a second abutting surface, the first flange is configured for abutting against the first abutting surface, and the second flange is configured for abutting against the second abutting surface; wherein, the first abutting surface is a conical surface, a diameter of the lampshade at a position corresponding to the first abutting surface gradually decreases along a direction towards the lamp base, and an included angle between the first abutting surface and the second abutting surface is an obtuse angle.

The lamp according to the embodiment of the disclosure at least has the following beneficial effects: the first abutting surface is the conical surface, and the diameter of the lampshade at a position corresponding to the first abutting surface gradually decreases along the direction towards the lamp base. It may be understood that the first abutting surface shrinks along the direction towards the lamp base. When the lampshade is gradually screwed into the lamp base, the contact between the first abutting surface of the lampshade and the first flange is gradually tight. The included angle between the first abutting surface and the second abutting surface is an obtuse angle. When the lampshade is screwed into the lamp base, the deeper the lampshade is screwed into, the closer the first flange and the second flange are connected with the outer wall of the lampshade.

According to some embodiments of the disclosure, the first abutting surface is formed at the position where the outer wall of the lampshade abuts against the first flange, the second abutting surface is formed at the position where the outer wall of the lampshade abuts against the second flange, and the included angle between the first abutting surface and the second abutting surface is an obtuse angle.

According to some embodiments of the disclosure, the second abutting surface is perpendicular to an axis of the lampshade.

According to some embodiments of the disclosure, a recess is formed between the second flange and the inner wall of the lamp base.

According to some embodiments of the disclosure, the first flange and the second flange are made of plastic materials.

According to some embodiments of the disclosure, the first flange and the second flange are integrally formed with the lamp base.

According to some embodiments of the disclosure, the lamp further includes a light emitting module for emitting light, wherein the light emitting module is detachably connected with a conducting terminal of the lamp base.

According to some embodiments of the disclosure, the light emitting module includes a shell, a lamp bead and a PCB board. The lamp bead is arranged in the shell and configured for emitting light. The PCB board is arranged in the shell and is electrically connected with the lamp bead.

According to some embodiments of the disclosure, an outer side of the shell is formed with a third flange, and one end of the lampshade towards the lamp base is capable of abutting against the third flange.

According to some embodiments of the disclosure, an outer wall of the shell is formed with scattering grains, and the scattering grains are configured for scattering the light emitted by the lamp bead.

A lamp string according to an embodiment of a second aspect of the disclosure includes the lamp according to the embodiment of the first aspect.

The lamp string according to the embodiment of the disclosure at least has the following beneficial effects: including all the beneficial effects of the lamp according to the embodiment of the first aspect, which will not be repeated here.

Part of the additional aspects and advantages of the disclosure will be given in part in the following description, and will become apparent in part from the following description, or will be learned through the practice of the disclosure.

BRIEF DESCRIPTION OF THE DRAWINGS

The disclosure will be further explained with reference to the accompanying drawings and embodiments hereinafter, wherein.

Figure 1:
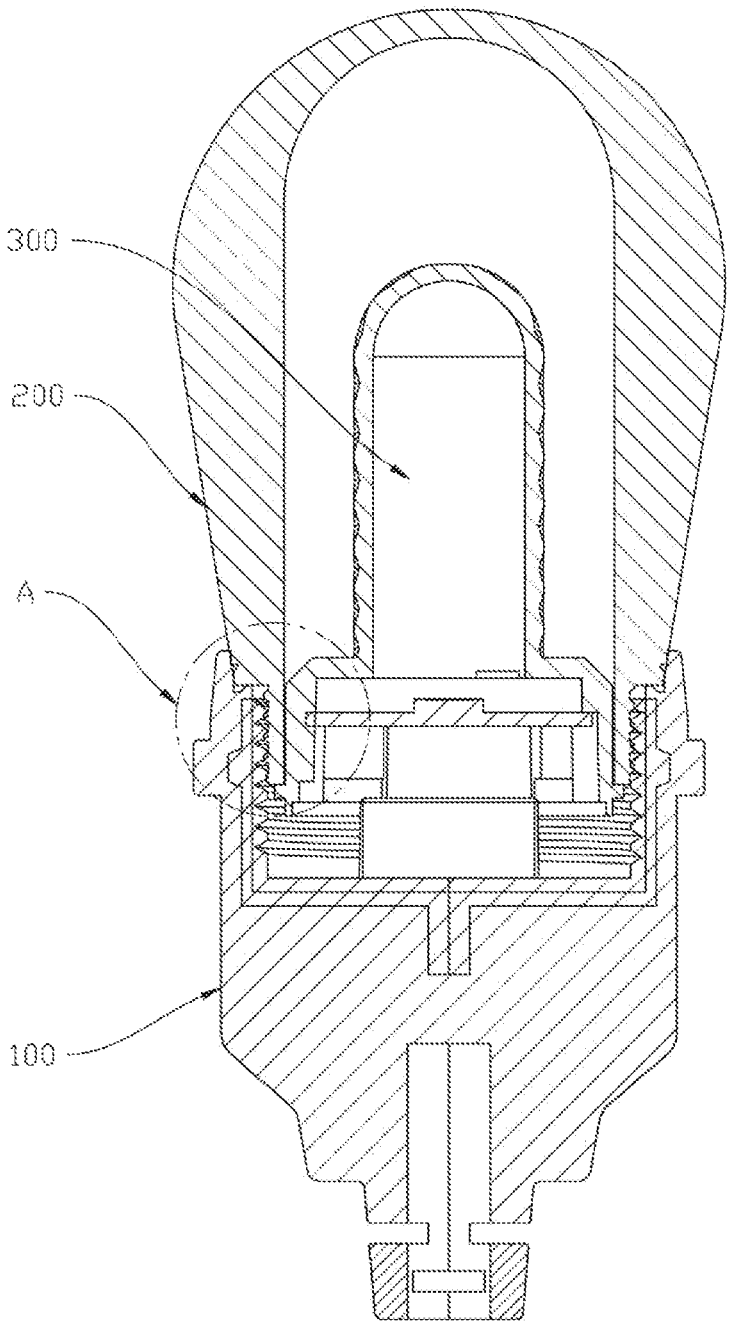
FIG. 1 is a sectional view of a lamp according to an embodiment of a first aspect of the disclosure.

Reference numerals: 100 refers to lamp base, 110 refers to first flange, 120 refers to second flange, 130 refers to conducting terminal, and 140 refers to recess; 200 refers to lampshade, 210 refers to first abutting surface, and 220 refers to second abutting surface; and 300 refers to light emitting module, 310 refers to shell, 311 refers to third flange, and 320 refers to lamp bead

DETAILED DESCRIPTION

Embodiments of the disclosure will be described in detail below. Examples of the embodiments are illustrated in the accompanying drawings, where the same or like reference numerals throughout the figures indicate the same or like elements having the same or like functions. The embodiments described below with reference to the accompanying drawings are exemplary and are intended only to explain the disclosure instead of being construed as limiting the disclosure.

In the description of the disclosure, it should be understood that, descriptions relating to orientation, for example, orientation or positional relationships indicated by "up", "down", "front", "back", "left", "right", etc. are based on the orientation or positional relationships shown in the accompanying drawings, and are to facilitate the description of the disclosure and simplify the description only, rather than indicating or implying that the device or element referred to must have a specific orientation or be constructed and operated in a specific orientation, and therefore cannot be construed as limiting the disclosure.

In the description of the disclosure, the meaning of "several" is one or more, the meaning of "a plurality of" is two or more, "greater than", "less than", "more than", etc. are to be understood to exclude the given figure, and "above", "below", "within", etc. are understood to include the given figure. If "first" and "second", etc. are referred to, it is only for the purpose of distinguishing technical features, and shall not be understood as indicating or implying relative importance or implying the number of the indicated technical features or implying the sequence of the indicated technical features.

In the description of the disclosure, unless otherwise explicitly defined, the words such as "set", "install", and "connect" should be understood in a broad sense, and those skilled in the art can determine the specific meanings of the above words in the disclosure in a rational way in combination with the specific contents of the technical solutions.

In the description of the disclosure, the descriptions with reference to the terms "an embodiment", "some embodiments", "illustrative embodiment", "example", "specific example" or "some examples", etc., refer to that specific features, structures, materials, or characteristics described with reference to the embodiments or examples are included in at least one embodiment or example of the disclosure. In the specification, the schematic representation of the above terms does not necessarily mean the same embodiment or example. Moreover, the specific features, structures, materials or characteristics described may be combined in any one or more embodiments or examples in a suitable manner.

As shown in FIG. 1 to FIG. 6, a lamp according to an embodiment of a first aspect of the disclosure includes a lamp base 100 and a lampshade 200.

As shown in FIG. 1, the lampshade 200 is connected with the lamp base 100. For example, the lampshade 200 is in thread connection with the lamp base 100. It is noted that the lampshade 200 may be in snap-fit connection with the lamp base 100, so that one end of the lampshade 200 can be fixed in the lamp base 100.

Figure 2:
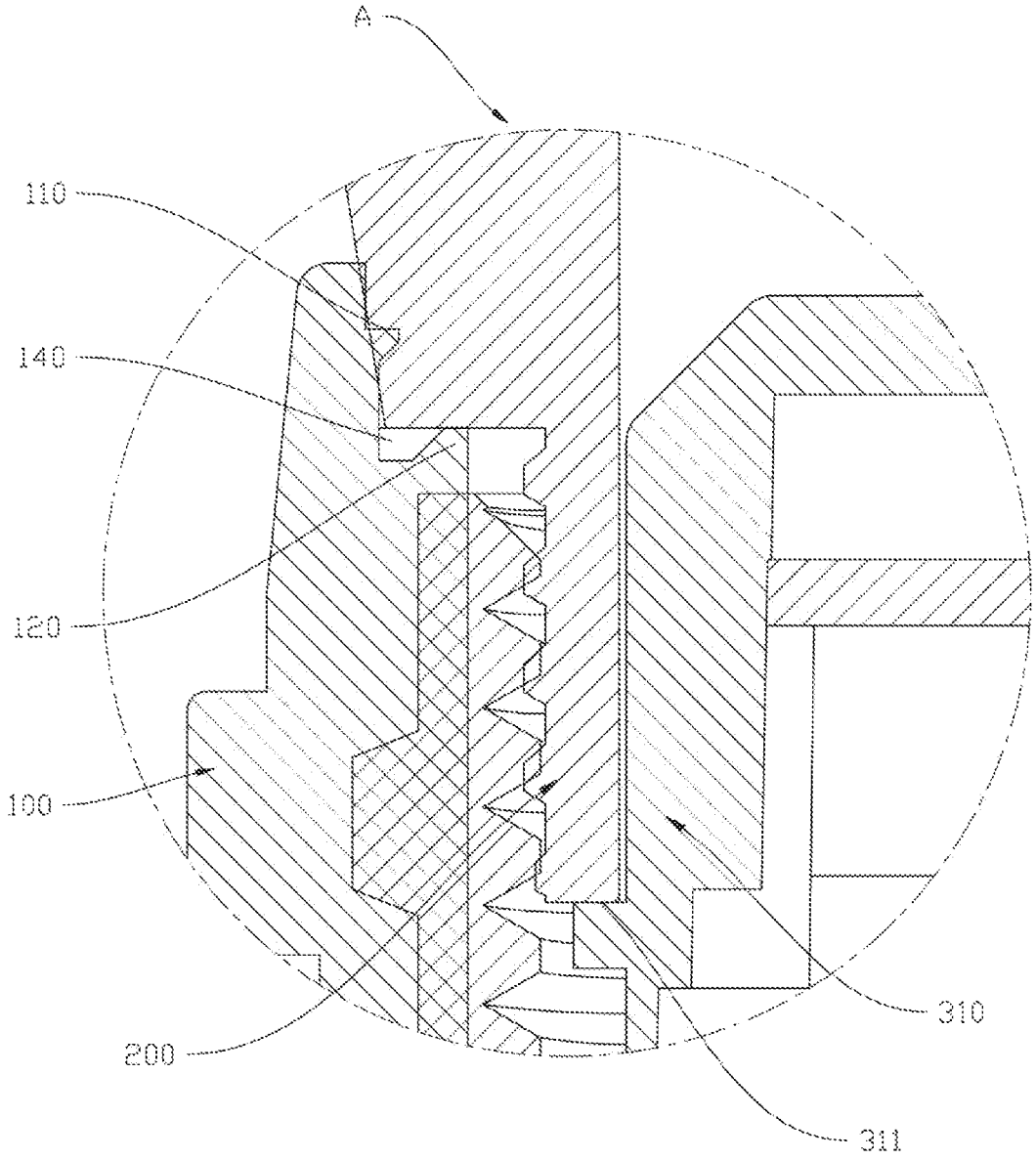
FIG. 2 is an enlarged view of a portion A in FIG. 1.
Figure 6:
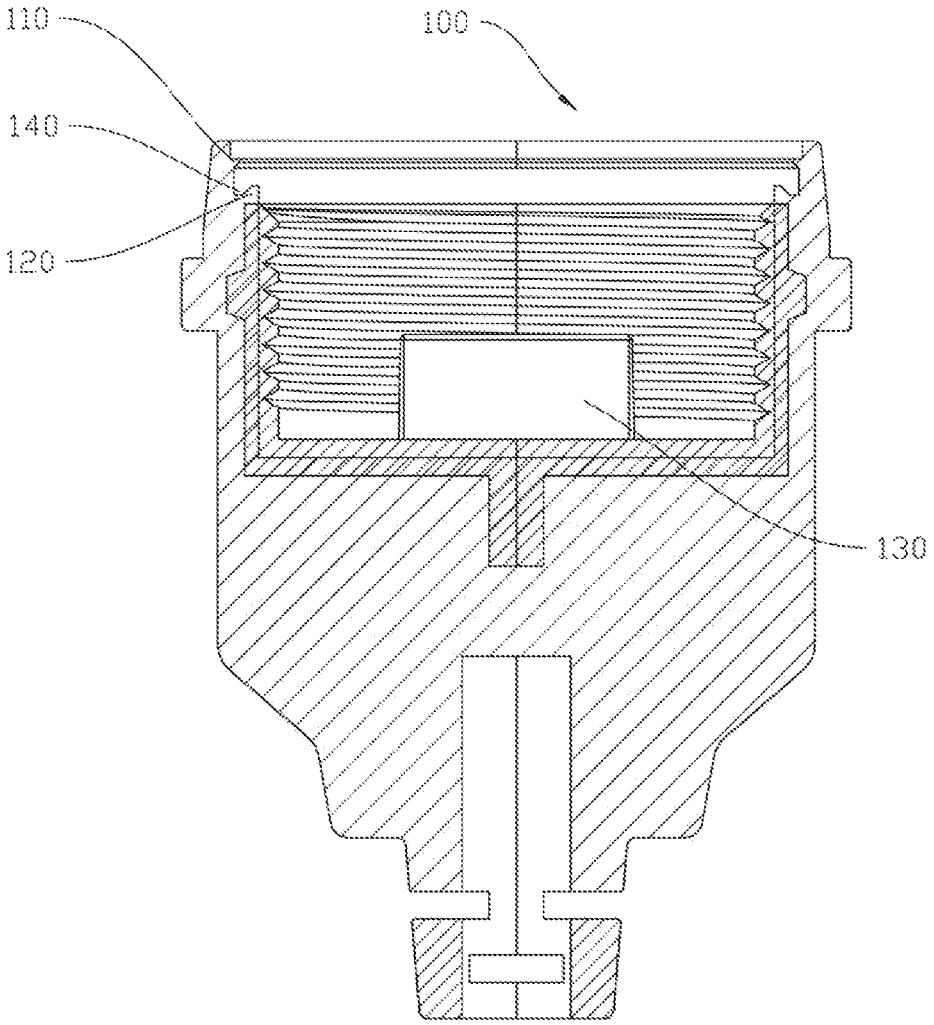
FIG. 6 is a sectional view of a lamp base according to the embodiment of the first aspect of the disclosure.

As shown in FIG. 1, FIG. 2 and FIG. 6, an inner wall of the lamp base 100 is provided with a first flange 110 and a second flange 120, an outer wall of the lampshade 200 is formed with a first abutting surface 210 and a second abutting surface 220, the first flange 110 abuts against the first abutting surface 210, and the second flange 120 abuts against the second abutting surface 220.

It may be understood that the first flange 110 and the second flange 120 are arranged along a circumferential direction of the lamp base 100. When one end of the lampshade 200 is screwed into the lamp base 100, the first flange 110 and the second flange 120 respectively abut against the outer wall of the lampshade 200, so that two sealing positions are formed between the lampshade 200 and the lamp base 100, thus achieving a double water-proofing effect, and improving water-proofing property of the lamp.

Specifically, the base is in interference fit with the lampshade 200 through the first flange 110 and the second flange 120, so that the first flange 110 and the second flange 120 can be tightly connected to the outer wall of the lampshade 200.

Figure 4:
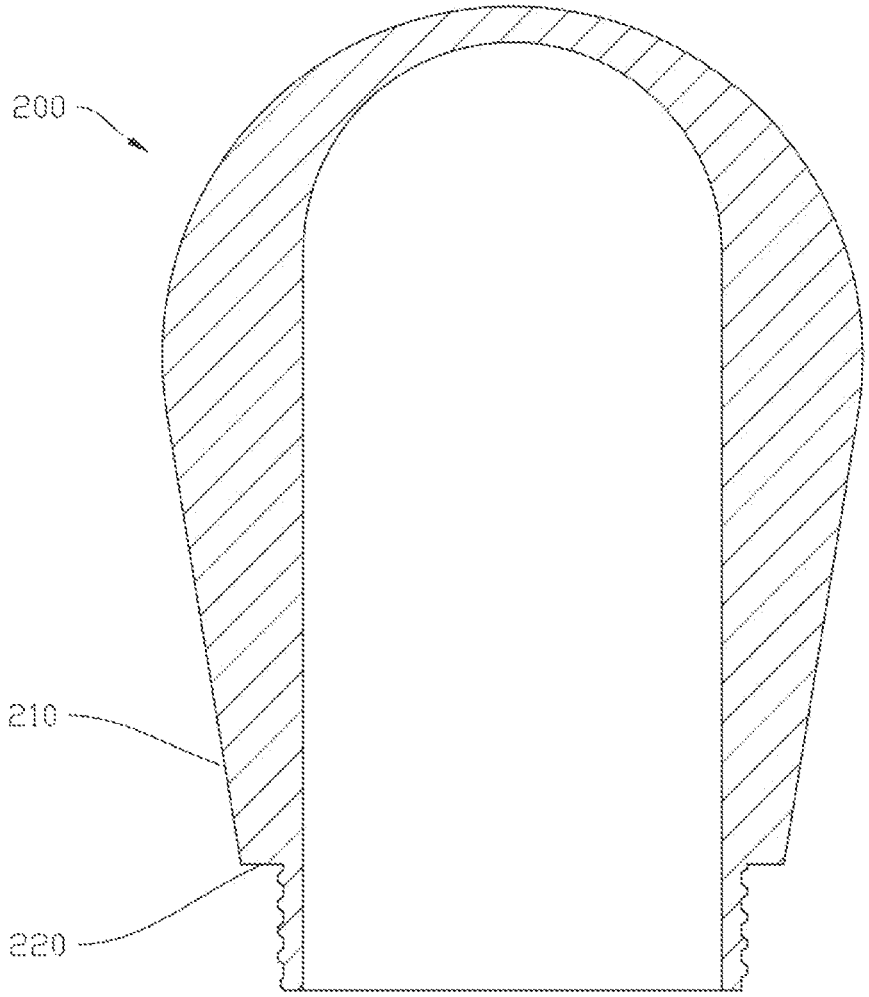
FIG. 4 is a sectional view of a lampshade according to the embodiment of the first aspect of the disclosure.
Figure 5:
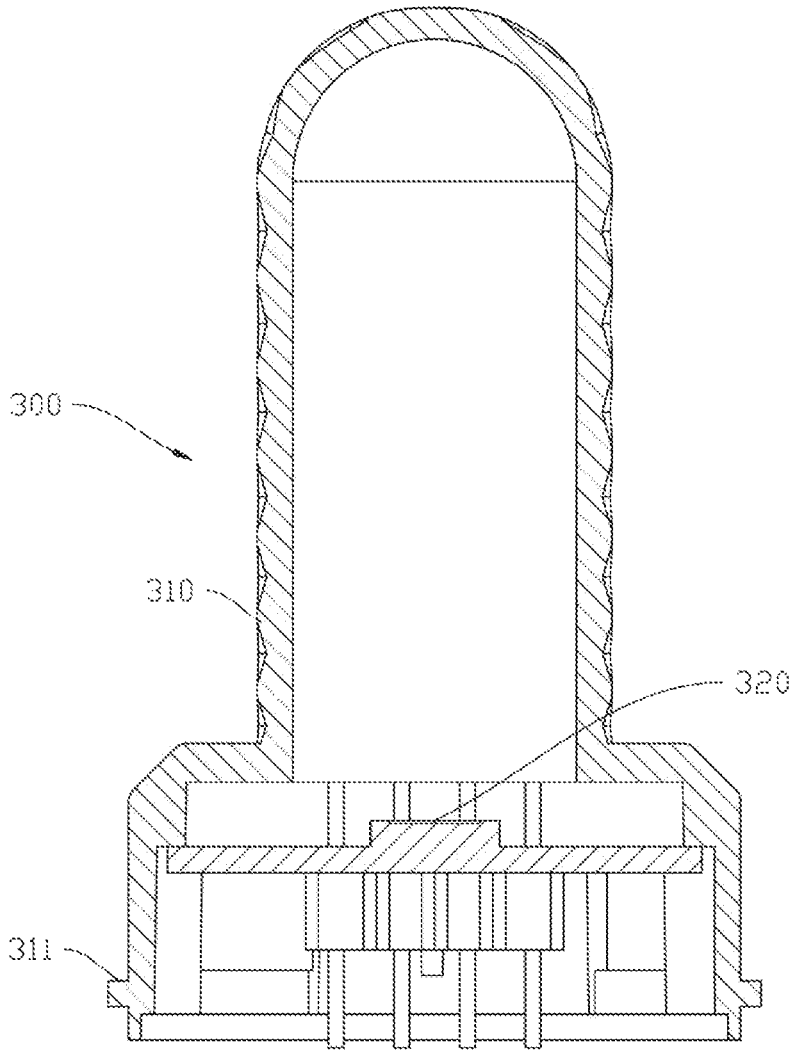
FIG. 5 is a sectional view of a light emitting module according to the embodiment of the first aspect of the disclosure.

As shown in FIG. 4, the first abutting surface 210 is a conical surface, a diameter of the lampshade 200 at a position corresponding to the first abutting surface 210 gradually decreases along a direction towards the lamp base 100. It may be understood that the first abutting surface 210 shrinks along the direction towards the lamp base 100. When the lampshade 200 is gradually screwed into the lamp base 100, the contact between the first abutting surface 210 of the lampshade 200 and the first flange 110 is gradually tight.

An included angle between the first abutting surface 210 and the second abutting surface 220 is an obtuse angle. Specifically, the first abutting surface 210 and the second abutting surface 220 are sequentially arranged at one end of the lampshade 200 connected with the lamp base 100. When the lampshade 200 is screwed into the lamp base 100, the first abutting surface 210 will contact with the first flange 110 first. As the lampshade 200 goes deeper into the lamp base 100, the second abutting surface 220 will contact with the second flange 120. In addition, the first flange 110 and the second flange 120 may compress the lampshade 200 in different directions to improve the water-proofing effect of the lamp.

For instance, when the lampshade 200 is initially screwed into the lamp base 100, the contact between the lampshade 200 and the first flange 110 is gradually tight. The second abutting surface 220 is perpendicular to an axis of the lampshade. 200. When the lampshade 200 is screwed deeper into the lamp base 100, the second flange 120 abuts on the second abutting surface 220 and compress the lampshade 200 in a direction parallel to the axis of the lampshade 200. The deeper the lampshade 200 is screwed into, the tighter the connections between the first flange 110 and the outer wall of the lampshade 200 and between the second flange 120 and the outer wall of the lampshade 200 are.

Moreover, the first flange 110 and the second flange 120 are made of plastic materials. When the first flange 110 and the second flange 120 are pressed against the outer wall of the lampshade 200, the first flange 110 and the second flange 120 can have a certain deformation effect, which improves the connection tightness between the first flange 110 and the second flange 120 and the lampshade 200.

It should be noted that the first flange 110 and the second flange 120 are integrally formed with the lamp base 100.

As shown in FIG. 1, FIG. 2 and FIG. 4, it may be understood that the second abutting surface 220 is perpendicular to the axis of the lampshade 200. It should be noted that the direction in which the lampshade 200 is screwed into the base 100 is parallel to the axis of the lampshade 200. When the lampshade 200 is screwed into the base 100 deeply, the second flange 120 can compress the lampshade 200 in a direction opposite to the screwing direction, that is, the deeper the lampshade 200 is screwed into, the tighter the second flange 120 is connected with the lampshade 200.

As shown in FIG. 2 and FIG. 6, it may be understood that a recess 140 is formed between the second flange 120 and the inner wall of the lamp base 100.

It may be understood that the groove 140 forms a gap between the second flange 120 and the inner wall of the lamp base 100, so that when the second flange 120 is pressed against the lampshade 200, the second flange 120 can have a certain deformation space, so that the lampshade 200 can still be screwed in the direction of the lamp base 100 after the lampshade 200 is in contact with the second flange 120.

As shown in FIG. 2, it may be understood that the first flange 110 is integrally formed with the lamp base 100, and the second flange 120 is integrally formed with the lamp base 100, thus improving production efficiency of the lamp base 100 and reducing production costs.

Figure 3:
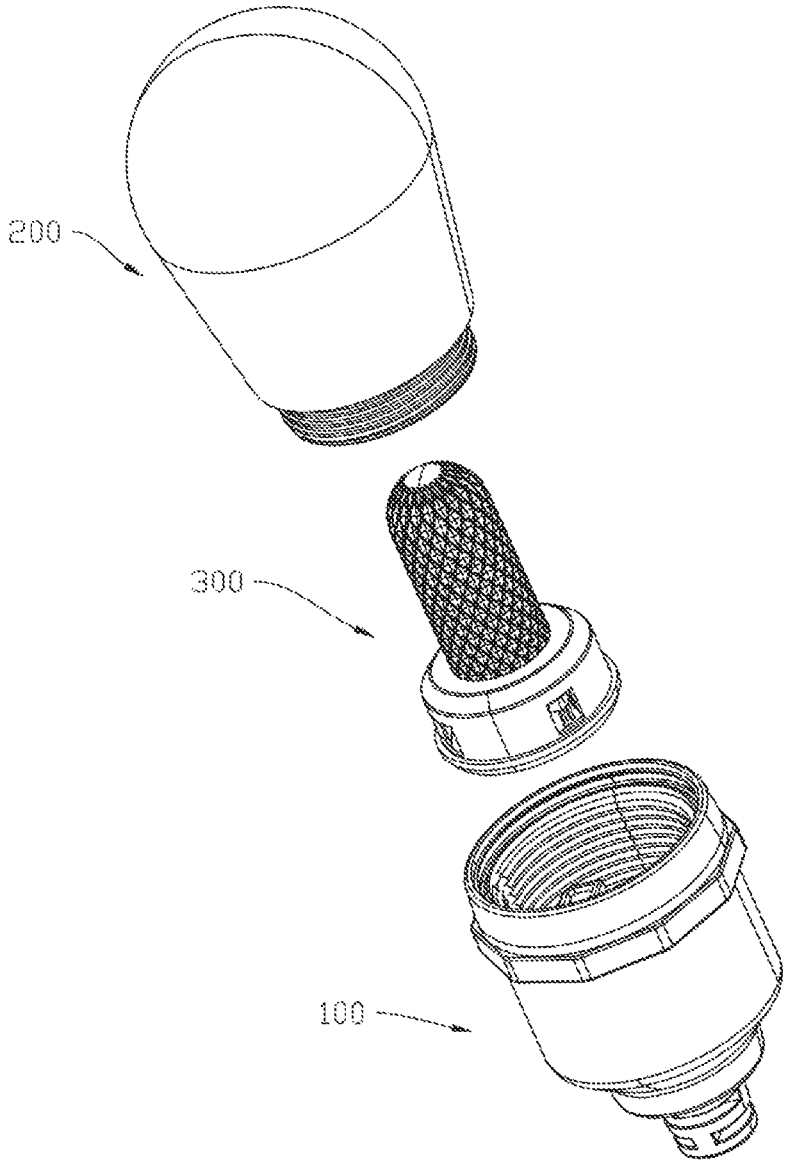
FIG. 3 is an exploded view of the lamp according to the embodiment of the first aspect of the disclosure.

As shown in FIG. 1 to FIG. 3, it may be understood that the lamp further includes a light emitting module 300 for emitting light, wherein the light emitting module 300 is detachably connected with a conducting terminal 130 of the lamp base 100. Compared with the lampshade 200 and the lamp base 100, the light emitting module 300 is easily damaged, and the light emitting module 300 is independently arranged, which can facilitate installation and replacement of the light emitting module 300. Specifically, the light emitting module 300 is plugged into the conducting terminal 130.

As shown in FIG. 1, FIG. 2, FIG. 3 and FIG. 5, it may be understood that the light emitting module 300 includes a shell 310, a lamp bead 320 and a PCB board. The lamp bead 320 is arranged in the shell 310 and configured for emitting light. The PCB board is arranged in the shell and is electrically connected with the lamp bead. It should be noted that the lamp bead 320 may have various light emitting states, such as always lighting, blinking or closing, and various light emitting colors, and the light emitting states of the lamp bead 320 may be controlled by the PCB board.

Moreover, as shown in FIG. 2, an outer side of the shell 310 is formed with a third flange 311, one end of the lampshade 200 towards the lamp base 100 is capable of abutting against the third flange 311, and the third flange 311 is configured for limiting.

As shown in FIG. 3, it may be understood that an outer wall of the shell 310 is formed with scattering grains, and the scattering grains are configured for scattering the light emitted by the lamp bead 320, so as to increase a light irradiation range of the lamp bead 320.

Figure 7:
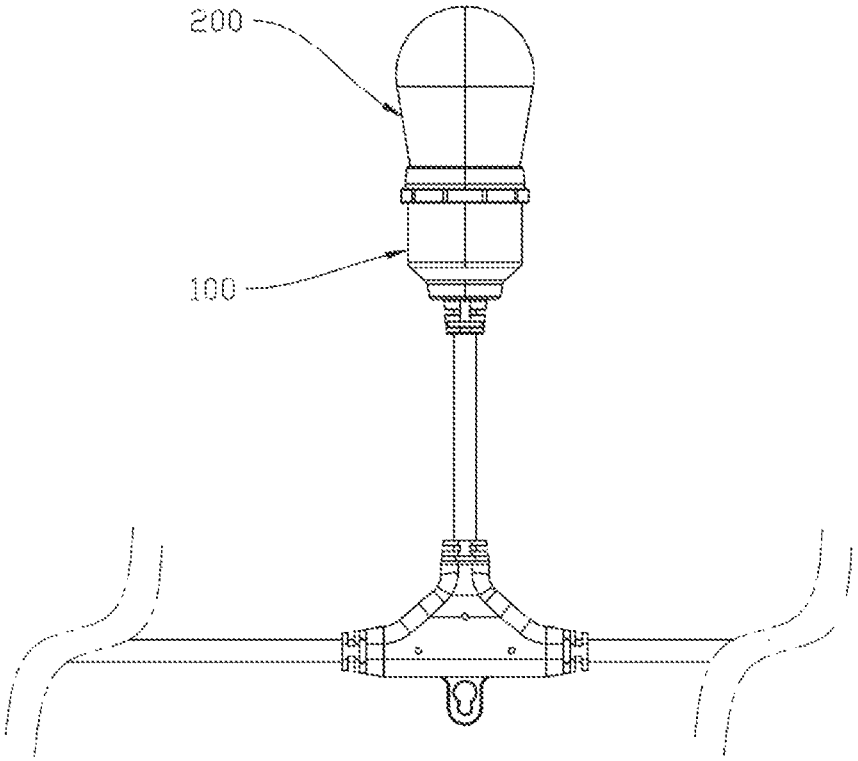
FIG. 7 is a schematic structural diagram of a lamp string according to an embodiment of a second aspect of the disclosure.

As shown in FIG. 7, a lamp string according to an embodiment of a second aspect of the disclosure includes a plurality of lamps electrically connected to one another, at least one of the lamps of the plurality of lamps comprising the lamp according to the embodiment of the first aspect.

It may be understood that the lamp string may be used as an outdoor atmosphere lamp. The outdoor air has a high water content, and the outdoor is prone to rainy days. The lamp of the first embodiment has a good water-proofing effect, which can prolong the service life of the lamp string.

The embodiments of the disclosure are described in detail with reference to the drawings above, but the disclosure is not limited to the above embodiments, and various changes may also be made within the knowledge scope of those of ordinary skills in the art without departing from the purpose of the disclosure. Moreover, in case of no conflict, the embodiments in the disclosure and the features in the embodiments may be arbitrarily combined with each other.

What is claimed is:

1. A lamp, comprising:

a lamp base; and a lampshade connected with the lamp base, wherein an inner wall of the lamp base is provided with a first flange and a second flange, an outer wall of the lampshade is formed with a first abutting surface and a second abutting surface, the first flange is configured for abutting against the first abutting surface, and the second flange is configured for abutting against the second abutting surface; wherein, the first abutting surface is a conical surface, a diameter of the lampshade at a position corresponding to the first abutting surface gradually decreases along a direction towards the lamp base, and an included angle between the first abutting surface and the second abutting surface is an obtuse angle;

wherein, an inner wall of the lamp base corresponding to the first abutting surface is divided by the first flange into two first areas and a second area, the two first areas surround the second area, and the first flange is located in the second area; wherein a second diameter of the inner wall of the lamp base corresponding to the second area is smaller than a first diameter of the inner wall of the lamp base corresponding to the two first areas to form an additional force between the first flange and the lampshade, thereby forming a stable clamping structure between the first flange and the lampshade;

wherein the first flange and the second flange respectively abut the first abutting surface and the second abutting surface to form two sealing positions between the lampshade and the lamp base as first threads at a bottom of the lampshade engage with second threads in the lamp base.

2. The lamp according to claim 1, wherein the second abutting surface is perpendicular to an axis of the lampshade.

3. The lamp according to claim 2, wherein a recess is formed between the second flange and the inner wall of the lamp base.

4. The lamp according to claim 1, wherein the first flange and the second flange are made of plastic materials, and the first flange and the second flange have a deformation effect.

5. The lamp according to claim 1, wherein the first flange and the second flange are integrally formed with the lamp base.

6. The lamp according to claim 1, further comprising a light emitting module for emitting light, wherein the light emitting module is detachably connected with a conducting terminal of the lamp base.

7. The lamp according to claim 6, wherein the light emitting module comprises:

a shell;

a lamp bead arranged in the shell and configured for emitting light; and a PCB board arranged in the shell, wherein the PCB board is electrically connected with the lamp bead.

8. The lamp according to claim 7, wherein an outer side of the shell is formed with a third flange, and one end of the lampshade towards the lamp base is capable of abutting against the third flange.

9. The lamp according to claim 7, wherein an outer wall of the shell is formed with scattering grains, and the scattering grains are configured for scattering the light emitted by the lamp bead.

10. A lamp string, comprising a plurality of lamps including at least one lamp comprising:

a lamp base; and a lampshade connected with the lamp base, wherein an inner wall of the lamp base is provided with a first flange and a second flange, an outer wall of the lampshade is formed with a first abutting surface and a second abutting surface, the first flange is configured for abutting against the first abutting surface, and the second flange is configured for abutting against the second abutting surface; wherein, the first abutting surface is a conical surface, a diameter of the lampshade at a position corresponding to the first abutting surface gradually decreases along a direction towards the lamp base, and an included angle between the first abutting surface and the second abutting surface is an obtuse angle;

wherein, an inner wall of the lamp base corresponding to the first abutting surface is divided by the first flange into two first areas and a second area, the two first areas surround the second area, and the first flange is located in the second area; wherein a second diameter of the inner wall of the lamp base corresponding to the second area is smaller than a first diameter of the inner wall of the lamp base corresponding to the two first areas to form an additional force between the first flange and the lampshade, thereby forming a stable clamping structure between the first flange and the lampshade;

wherein the first flange and the second flange respectively abut the first abutting surface and the second abutting surface to form two sealing positions between the lampshade and the lamp base as first threads at a bottom of the lampshade engage with second threads in the lamp base.

11. The lamp string according to claim 10, wherein the second abutting surface is perpendicular to an axis of the lampshade.

12. The lamp string according to claim 11, wherein a recess is formed between the second flange and the inner wall of the lamp base.

13. The lamp string according to claim 10, wherein the first flange and the second flange are made of plastic materials, and the first flange and the second flange have a deformation effect.

14. The lamp string according to claim 10, wherein the first flange and the second flange are integrally formed with the lamp base.

15. The lamp string according to claim 10, wherein the lamp further comprises a light emitting module for emitting light, wherein the light emitting module is detachably connected with a conducting terminal of the lamp base.

16. The lamp string according to claim 15, wherein the light emitting module comprises:

a shell;

a lamp bead arranged in the shell and configured for emitting light; and a PCB board arranged in the shell, wherein the PCB board is electrically connected with the lamp bead.

17. The lamp string according to claim 16, wherein an outer side of the shell is formed with a third flange, and one end of the lampshade towards the lamp base is capable of abutting against the third flange.

18. The lamp string according to claim 16, wherein an outer wall of the shell is formed with scattering grains, and the scattering grains are configured for scattering the light emitted by per the lamp bead.

* * * * *